US011549354B2

(12) United States Patent
Zarate Losoya et al.

(10) Patent No.: US 11,549,354 B2
(45) Date of Patent: Jan. 10, 2023

(54) METHODS FOR REAL-TIME OPTIMIZATION OF DRILLING OPERATIONS

(71) Applicant: The Texas A&M University System, College Station, TX (US)

(72) Inventors: Enrique Zarate Losoya, College Station, TX (US); Samuel F. Noynaert, College Station, TX (US); Ibrahim S. El-sayed, College Station, TX (US); Tyrell A. Cunningham, College Station, TX (US); Eduardo Gildin, College Station, TX (US)

(73) Assignee: The Texas A&M University System, College Station, TX (US)

( * ) Notice: Subject to any disclaimer, the term of this patent is extended or adjusted under 35 U.S.C. 154(b) by 365 days.

(21) Appl. No.: 16/294,807

(22) Filed: Mar. 6, 2019

(65) Prior Publication Data

US 2019/0277130 A1 Sep. 12, 2019

Related U.S. Application Data

(60) Provisional application No. 62/639,366, filed on Mar. 6, 2018.

(51) Int. Cl.
*E21B 44/00* (2006.01)
*E21B 7/04* (2006.01)
(Continued)

(52) U.S. Cl.
CPC ..... *E21B 44/00* (2013.01); *E21B 7/04* (2013.01); *E21B 41/0099* (2020.05); *E21B 49/003* (2013.01); *E21B 21/08* (2013.01)

(58) Field of Classification Search
CPC ..... E21B 44/00; E21B 7/04; E21B 49/003; E21B 21/08; E21B 45/00
See application file for complete search history.

(56) References Cited

U.S. PATENT DOCUMENTS 5,812,068 A * 9/1998 Wisler ..... E21B 47/26 175/45
6,206,108 B1 * 3/2001 MacDonald ..... E21B 49/005 175/24

(Continued)

FOREIGN PATENT DOCUMENTS

CN 105466670 A * 4/2016
CN 107942940 A * 4/2018
WO WO-2014003269 A1 * 1/2014 ..... B22D 11/20

OTHER PUBLICATIONS

S. Noynaert and E. Gildin, "Going Beyond the Tally Book: A Novel Method for Analysis, Prediction and Control of Directionally Drilled Wellbores using Mechanical Specific Energy", 2014 (Year: 2014).*

*Primary Examiner* — Douglas Kay
(74) *Attorney, Agent, or Firm* — Conley Rose, P.C.

(57) ABSTRACT

In some examples, a method performed by a drilling rig control center, includes receiving raw data for a first time segment, the raw data related to a drilling operation. In addition, the method includes deriving first drilling state measurements based on the raw data of the first time segment. Further, the method includes deriving first formation state measurements based on the raw data of the first time segment. The method also includes correlating the first derived drilling and formation state measurements of the first time segment with a second derived drilling and formation state measurements of a second time segment. Still further, the method includes generating a control response based on the correlation.

19 Claims, 5 Drawing Sheets

(51) Int. Cl.

| | |
|---|---|
| ***E21B 49/00*** | (2006.01) |
| ***E21B 41/00*** | (2006.01) |
| *E21B 21/08* | (2006.01) |

(56) References Cited

U.S. PATENT DOCUMENTS

| | | | | |
|---|---|---|---|---|
| 6,272,434 | B1 * | 8/2001 | Wisler | E21B 47/26 702/9 |
| 6,727,696 | B2 * | 4/2004 | Kruspe | E21B 43/26 324/303 |
| 7,193,414 | B2 * | 3/2007 | Kruspe | E21B 49/008 324/303 |
| 7,258,175 | B2 * | 8/2007 | Veeningen | E21B 10/00 175/40 |
| 7,357,196 | B2 * | 4/2008 | Goldman | E21B 12/02 175/24 |
| 8,121,971 | B2 * | 2/2012 | Edwards | G06N 5/025 706/50 |
| 9,482,084 | B2 * | 11/2016 | Chang | E21B 44/00 |
| 9,696,198 | B2 * | 7/2017 | Turner | E21B 44/00 |
| 9,857,271 | B2 * | 1/2018 | Dashevskiy | E21B 41/00 |
| 10,422,912 | B2 * | 9/2019 | Holtz | E21B 4/003 |
| 10,803,324 | B1 * | 10/2020 | Shen | G06K 9/00818 |
| 10,876,926 | B2 * | 12/2020 | Dashevskiy | E21B 41/00 |
| 2005/0236184 | A1 * | 10/2005 | Veeningen | E21B 10/00 175/40 |
| 2006/0157277 | A1 * | 7/2006 | Bittar | E21B 47/00 175/26 |
| 2014/0277752 | A1 * | 9/2014 | Chang | E21B 44/00 700/275 |
| 2015/0153433 | A1 * | 6/2015 | Paulsen | G01V 3/32 324/309 |
| 2018/0120201 | A1 * | 5/2018 | Dashevskiy | G01M 13/00 |
| 2020/0173268 | A1 * | 6/2020 | Zhang, Jr. | E21B 31/00 |

* cited by examiner

METHODS FOR REAL-TIME OPTIMIZATION OF DRILLING OPERATIONS

CROSS-REFERENCE TO RELATED APPLICATIONS

This application claims benefit of U.S. provisional patent application Ser. No. 62/639,366 filed Mar. 6, 2018, and entitled "Methods and Apparatus for Intelligent Drilling Control System," which is hereby incorporated herein by reference in its entirety.

STATEMENT REGARDING FEDERALLY SPONSORED RESEARCH OR DEVELOPMENT

Not applicable.

SUMMARY

In accordance with at least an example, a method performed by a drilling rig control center, comprises receiving raw data for a first time segment, the raw data related to a drilling operation; deriving first drilling state measurements based on the raw data of the first time segment; deriving first formation state measurements based on the raw data of the first time segment; correlating the first derived drilling and formation state measurements of the first time segment with a second derived drilling and formation state measurements of a second time segment; and generating a control response based on the correlation.

In accordance with at least an example, a method for real-time optimization of a drilling operation, comprises receiving raw data of the drilling operation; extrapolating a mechanical specific energy of the drilling operation by providing the raw data to a trained system; extrapolating rock strata data where the drilling operation is performed by providing the raw data to the trained system; comparing the mechanical specific energy with a previously-stored mechanical specific energy of the drilling operation; comparing the first rock strata data with a previously stored rock strata data; and generating a control response based on the comparisons.

In accordance with at least an example, a system, comprises a drilling rig control center configured to: receive raw data for a first time segment, wherein the raw data is related to a drilling operation; derive a first drilling-state measurement based on the raw data of the first time segment; derive a first formation state measurements based on the raw data of the first time segment; correlate the first derived drilling and formation state measurements of the first time segment with a second derived drilling and formation state measurements of a second time segment; and generate a control response based on the correlation.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various examples, reference will now be made to the accompanying drawings in which.

DETAILED DESCRIPTION

The drilling of wells during oil and gas exploration consumes a large portion of the cost involved. Drilling costs have increased substantially in recent years, considering that many of the new wells require oil and gas companies to dig much deeper than the wells of the past. The deeper wells are less-accessible, thus are much more complex to drill, and often cost higher than the wells that are relatively more-accessible. In addition, the extreme depths to which modern wells are now being drilled add many complications to the drilling process, including the cost and effort required to address drilling problems that may occur at such extreme depths and with such increased well complexity.

With the increased costs in modern drilling, it is all the more critical for the drilling operation to be carried out accurately and efficiently. Thus, a skilled driller or drilling engineer, who is the primary decision-maker at the drilling rig, is needed in order to safely drill the well as planned. In some cases, to aid the decision making of the skilled driller/drilling engineer, power of information (or data) may be harnessed and additional drilling data may be provided to the driller. Currently used systems run local optimization based on history or model-based data that takes into account, for instance, drilling dysfunction and then automatically mitigate the issue by controlling (e.g., changing) one or more of the drilling parameters (e.g., weight on bit (WOB)) or advice/indicate the skilled driller to change that parameter while monitoring large amount of incoming data. These currently used techniques are not able to generate a step change in drilling efficiency because these approaches do not account for historical drilling data. Therefore, it would be desirable to have a drilling control system that can provide step change to drilling efficiency, which further allows for an improved completion design of the well.

Figure 1:
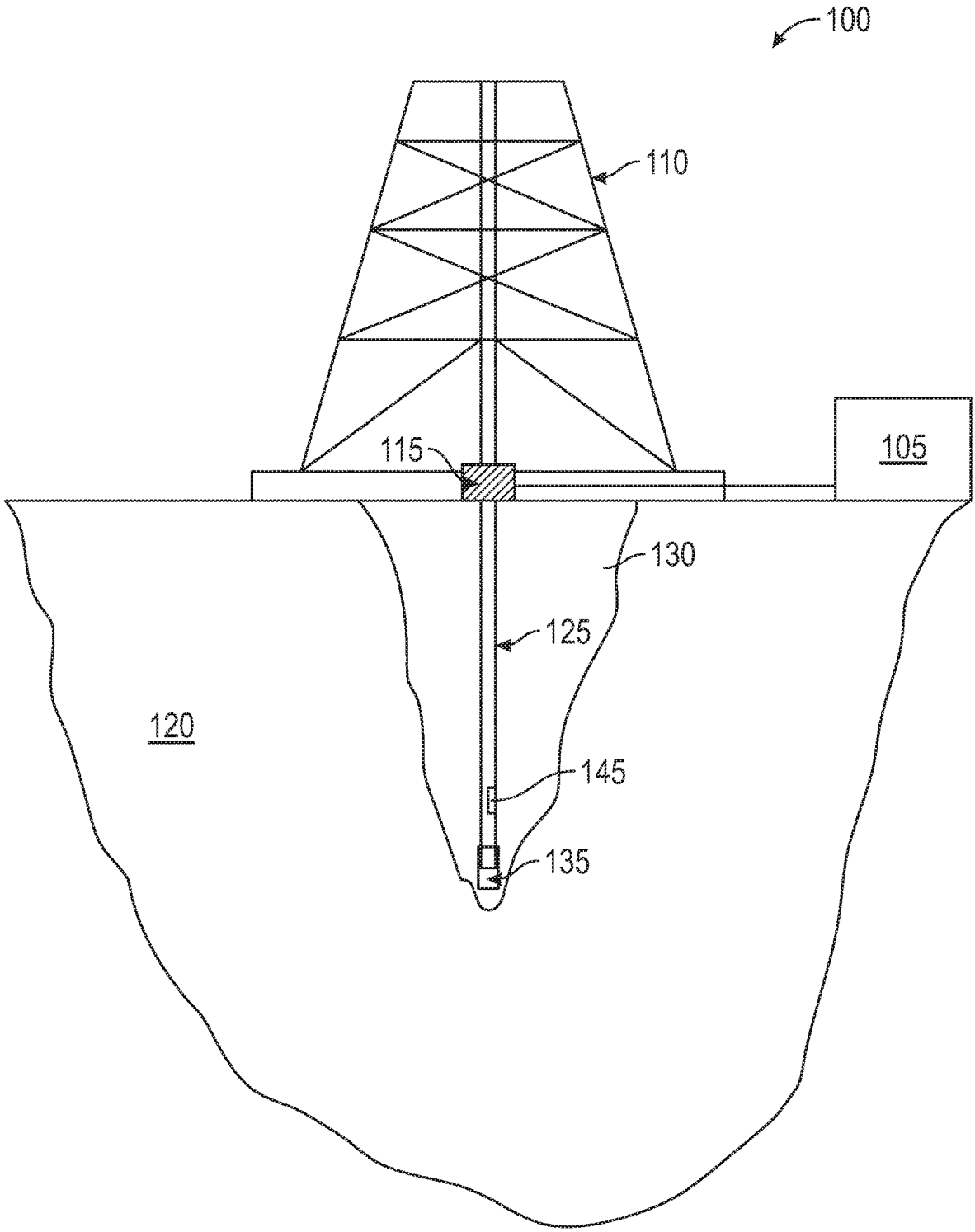
FIG. 1 depicts an illustrative side-view of a generic drilling site, in accordance with various examples.

Accordingly, at least some of the examples disclosed herein are directed to drilling control systems and methods that include monitoring real-time data to diagnose drilling parameters to optimally drill a well. In particular, the system disclosed herein derives information from and classifies the monitored real-time data, and then correlates the derived and classified data with a similar data set from a previous instance to generate a control response. In some examples, the data is derived and classified using a learned system, which facilitates generating control responses that further result in improved geo-steering and completion design of the well Referring now to FIG. 1, an illustrative side-view of a drilling site 100 is shown. FIG. 1 depicts a land-based drilling site 100. However, FIG. 1 is primarily provided to give some context in which the drilling control systems and methods disclosed herein may be employed. Thus, the drilling control systems and methods are not limited to land-based drilling sites, but may also be employed in offshore or other types of drilling environments.

As depicted in FIG. 1, the drilling site 100 includes a drilling rig 110 that is disposed above a well 130. The drilling rig 110 includes a drill string 125 that has a drill bit 135 towards the end thereof. The drilling rig 110, in some examples, includes a parameter control and uphole sensor unit 115 that is configured to control one or more of the drilling parameters including, without limitation, weight-on-bit (WOB), rate-of-penetration (ROP), rotation-per-minute (RPM), and drilling fluid pressure. In some examples, the parameter control and uphole sensor unit 115 may include a pressure control system and may contain sensors for detecting certain operating parameters and controlling the actuation of the pressure of the drilling fluid that is impregnated in the well 130. In other examples, the parameter control and uphole sensor unit 115 can also be configured to control the WOB, which impacts the ROP of the drill bit 135. The parameter control and uphole sensor unit 115 may include sensors to measure uphole drilling rig 110 data, such as uphole WOB, RPM, casing pressure, depth of the drill bit 135, and the drill bit type. In some examples, measurements of the drilling fluid (or mud) are also captured at the rig. The parameter control and uphole sensor unit 115 is described above to perform several different functions; however, in practical implementation, these functions may be performed a combination of one or more control and sensor units.

It may be desirable while drilling to gather data related to the drilling process and the formations through which the drill bit 135 penetrates. Thus, different other measurements are gathered while drilling, and such measurements may be captured by downhole sensors 145 attached to the drilling string 125. The description hereinbelow provides examples of the types of sensors that are used and the data that is collected. In a practical implementation, some of the sensors described below may be employed. Also, the following description is not exhaustive. The downhole sensors 145 may include different sets of sensors, one set capturing data while the drill bit 135 is drilling, and this type of measurement is sometimes referred to as logging-while-drilling (LWD). LWD measurements may be related to the formation and contents of the rock the drill bit 135 is drilling through. The other set of sensors may capture data related to the drill string 125 and the drill bit 135, and this type of measurement is sometimes referred to as measurement-while-drilling (MWD).

The sensors that capture LWD data may include a gamma ray sensor, a resistivity sensor, a neutron sensor, an NMR sensor, a formation-sampling sensor, a sonic sensor, and other relevant sensors. These sensors are employed to gather formation data, such as the porosity, density, lithology, dielectric constant, layer interfaces, type, pressure, and fluid permeability. The sensors capturing MWD data may measure the downhole weight and torque on the drill bit 135, and may also capture data related to the bending movements of the drill bit 135.

The uphole and downhole sensors are configured to communicate the collected data to a location at the drilling rig 110 using telemetry tools and methods. Telemetry methods, in one example, include mud-pulse telemetry, which is generally not instantaneous, and thus, the data received by the location at the drilling rig 110 will be delayed. FIG. 1 further depicts a drilling rig control center 105, which monitors data received from the uphole and downhole sensors to optimize drilling parameters, which further results in an optimally-drilled well. The monitored data is received by a trained system that is developed off-line (e.g., in a lab or a factory) and is then implemented on-line at the drilling rig for on-site drilling optimization. This trained system may be continually re-trained on-site using the real-time data received from the uphole and downhole sensors.

The trained system derives formation state data from the real-time data received from the uphole and downhole sensors. In some examples, formation state data includes information pertaining to the rock being drilled. In some examples, the formation state data includes the probability of the formation state data being correct. The formation state data may further be classified by the trained system. For example, the formation state data could be classified into more general rock types such as sandstone, shale, or limestone. The formation state data could also be classified into more refined categories such as sandy-shale or carbonate-rich shale. The formation state data could be classified into specific rock formations for a given area. In some examples, formation state data includes rock petrophysical and other reservoir-related data such as porosity, pore pressure, and the percentage of rock types in a particular interval. A potential use of such data and properties is geosteering; for example, determining if the drilling bottom hole assembly (BHA) and bit are within the targeted pay zone. The trained system also derives drilling state data from the real-time data received from the uphole and downhole sensors. In some examples, drilling state data includes information pertaining to the drill string 125 (FIG. 1) and drill bit 135 (FIG. 1). For example, displacement, rate-of-penetration, mechanical specific energy, etc.

The drilling state data may further be classified by the trained system. For example, the trained system is trained to indicate whether there is vibrational dysfunction downhole using the instant set of data that is received from the uphole and downhole sensors. In some examples, the trained system may also provide more information about the formation and its contents. For example, the formation lithology, compressive strength, shear strength, abrasiveness, and conductivity. In some examples, even more measurements may be gathered by the trained system. For example, temperature, density, and gas content may also provide data related to the formation and its contents. As further described in FIG. 3, the derived and classified data is correlated with a similar data set from a previous instance to generate a control response.

Figure 2:
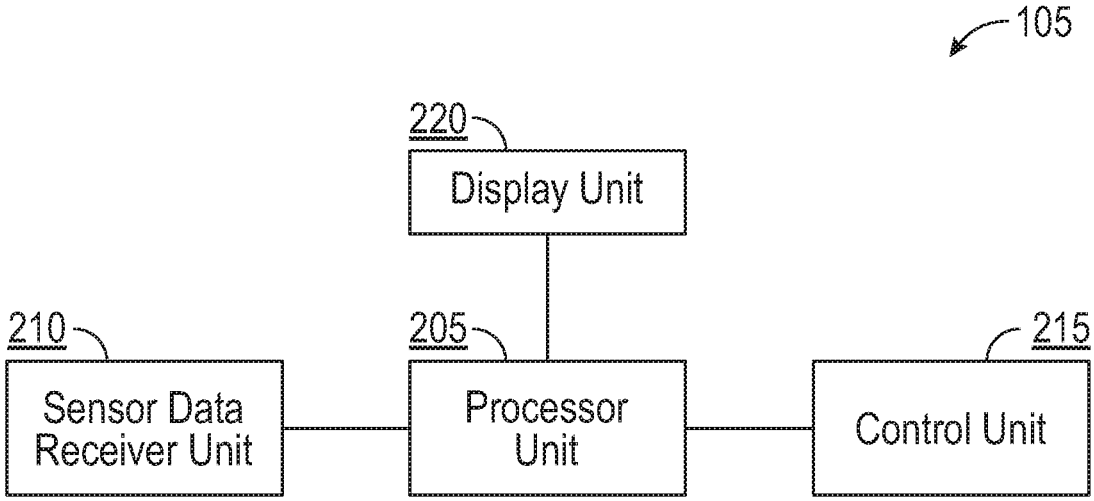
FIG. 2 depicts an illustrative schematic diagram of a drilling rig control center, in accordance with various examples.

Referring now to FIG. 2, a schematic diagram of the drilling rig control center 105 is shown. The drilling rig control center 105, in some examples, includes a sensor data receive unit 210, a processor unit 205, a control unit 215, and a display unit 220. The sensor data receiver unit 210 is configured to collect data, such as uphole and downhole sensor data and wireline data, from downhole tools. This received data may then be communicated, through to the processor unit 205, or to locations where the data may be useful or needed. The processor unit 205 may include a memory and an I/O port. In some examples, the processor unit 205 may further include one or more microprocessors or digital signal processors (DSPs). In some examples, in addition to the microprocessors or DSPs, or alternatively, the processor unit 205 may include one or more application specific integrated circuits (ASICs) or field programmable gate arrays (FPGA). In some examples, the memory 220 may include random access memory (RAM), read-only-memory (ROM), removable disk memory, flash memory, or a combination of these types of memories. The memory in the processor unit 205 may, at least in part, be used as cache (or buffer) memory, and typically includes an operating system (OS), which may be one of current or future commercially available operating systems such as, but not limited to, LINUX®, Real-Time Operating System (RTOS), etc.

In some examples, the processor unit 205 has the trained system installed in it, and thus, the processor unit 205 is configured to perform the functions of the trained system. The control unit 215 is configured to act in fully-automatic mode in that the control unit 215 received data from the trained system and perform relevant actions without any human intervention. In other examples, a skilled engineer may use information indicated or relayed by the processor unit to the display unit 220 and perform relevant actions using the control unit. In that scenario, the control unit 215 functions semi-automatically. The relevant functions performed by the skilled engineer may include changing drilling parameters (WOB, RPM, fluid (or mud) flow, differential pressure, torque, etc.). In other examples, relevant functions may also include steering the direction of the drill bit 135 (FIG. 1). In other examples, a skilled engineer would evaluate complex operational conditions and problems based on the analyses carried by the trained system.

Figure 3:
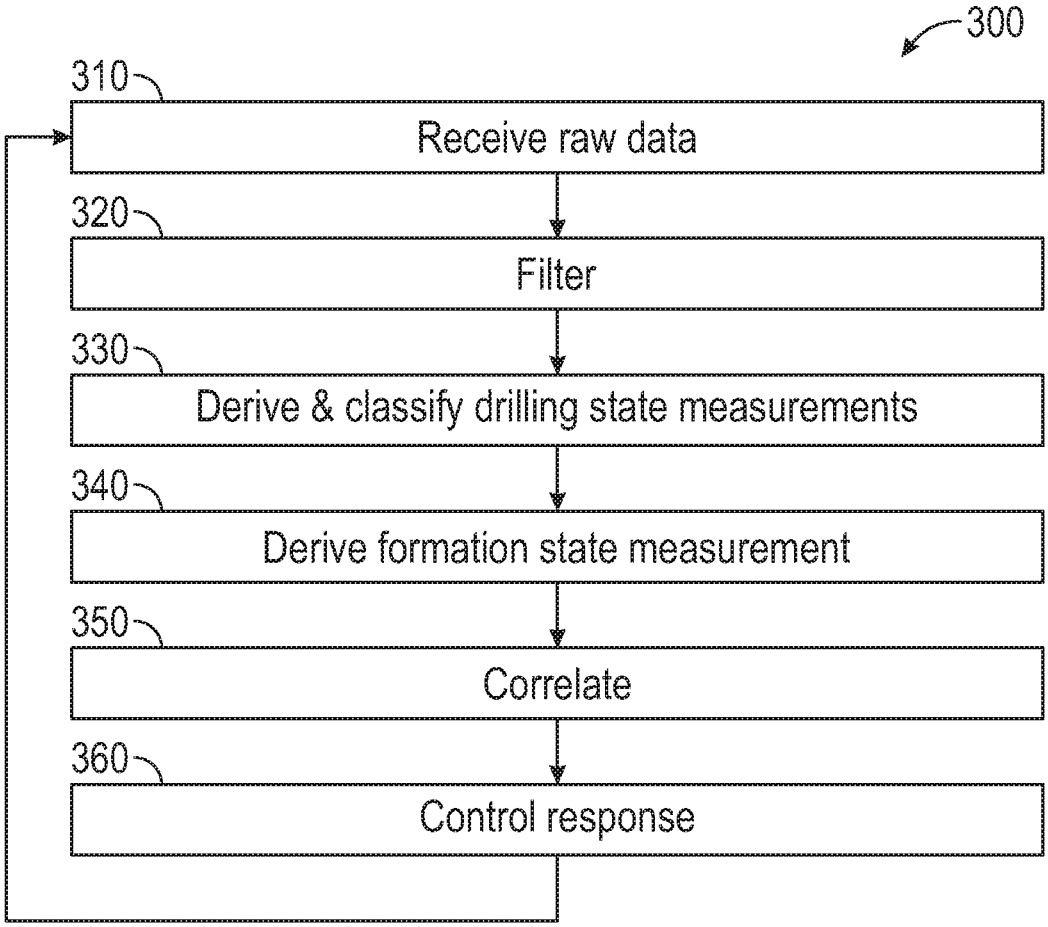
FIG. 3 depicts an illustrative method performed by the drilling rig control center, in accordance with various examples.

Referring now to FIG. 3, an illustrative method 300 that may be performed by the drilling rig control center 105 to generate a control response. In some examples, the control response is implemented by the parameter control and uphole sensor unit 115. For example, the parameter control and uphole sensor unit 115 may be configured to change drilling parameters (WOB, RPM, fluid or mud flow, etc.) of the drill bit 135. In some examples, the unit 115 may be configured to change the steering the direction of the drill bit 135 (FIG. 1) in order to produce improve the completion design of the well.

The method 300 is now described in connection with FIGS. 1, 2, and 3. The method 300 begins with step 310 that includes receiving raw data for a first time segment, where the raw data is received by the downhole sensors 145 that provide uphole and downhole data related to the drilling operation, for instance data generated from electronic data recording (EDR) tools and/or the MWD tools. For example, raw data related to the drilling state, such as WOB, revolutions per minute (RPM) of the drill bit 135, torque applied by the unit 115, mud pump pressure; and raw data related to the lithology of the formation, such as porosity, density, lithology, dielectric constant, layer interfaces, type, pressure, and fluid permeability may be received by the sensor receiver unit 210. In some examples, the sensor receiver unit 210 may send the received data to the processor unit 205 for further processing steps. Data from the sensor mentioned above may be received for a time segment. For example, the downhole and uphole sensors may send five minutes' worth of raw data to the sensor data receiver unit 210.

Following step 310, method 300 proceeds to step 320 that includes filtering the received raw data. Filtering is performed for formatting and cleaning the raw data and for outlier deletion from the raw data. In some examples, filtering may be performed by using one or more analog or digital filters as well as other signal filtering techniques. For example, raw data can be first filtered using a fifth-order median filter and then by a third-order butter-worth low-pass filter. Step 320 may be performed by the processor 205. After performing the step 320, the method 300 may proceed to step 330 that includes deriving drilling state measurements by using the filtered data. In other words, the derived drilling state measurements will be based on the raw data of the first time segment because the filtered data is obtained through the raw data. In some examples, the derived drilling state measurements include rate of penetration (ROP), depth of cut (DOC), surface and bit mechanical specific energy, dogleg severity or other tortuosity indexes, torque and torsional forces, downhole RPM, vibrations magnitudes and frequencies, azimuth, inclination, and tool-face orientation. In one example, the drilling state measurements are derived using the trained system, the training methodology of which is described ahead in FIG. 4.

Following the step 330, the method 300 may proceed to step 340 that includes deriving formation state measurements based on the raw data of the first time segment. In some examples, the derived formation state measurements include rock type, lithology such as sandstone, shale, granite, interface, gravel, cement, porosity, permeability, temperature, etc. In some examples, to improve the accuracy of the trained system, the raw data received in step 310 is continuously used to re-train the trained system. After deriving both formation and drilling states, the method 300 proceeds to step 350 that includes correlating the instant derived drilling and formation state measurements of the first time segment with a second derived drilling and formation state measurements of a second time segment. In one example, the second derived drilling and formation state measurements are the drilling and formation state measurements of a previous time segment. For example, comparing and correlating derived measurements, such as mechanical specific energy, torque oscillations and accelerations, the processor 205 can infer a change in lithology at which the drill bit 135 is drilling through. Based on this inference, the processor 205 may generate a control response (step 360) that may be provided at the parameter control and uphole sensor unit 115, which can (automatically or semi-automatically) change certain parameters (e.g., WOB) of the drilling system to optimize the drilling process. In some examples, the correlation performed in the step 350 may be done by supervised or unsupervised trained systems.

In some examples, the control response may further, either by indicating to the skilling engineer, or in one example, automatically, steer the drill bit 135 in a different direction. Steps 330-360 may be performed by the processor 205 and the derived information in steps 330, 340 are stored in a memory in the processor 205. This stored information is used in the next cycle of drilling optimization. After performing the control response, the method 300 returns to receiving raw data for the next cycle of drilling optimization.

Figure 4:
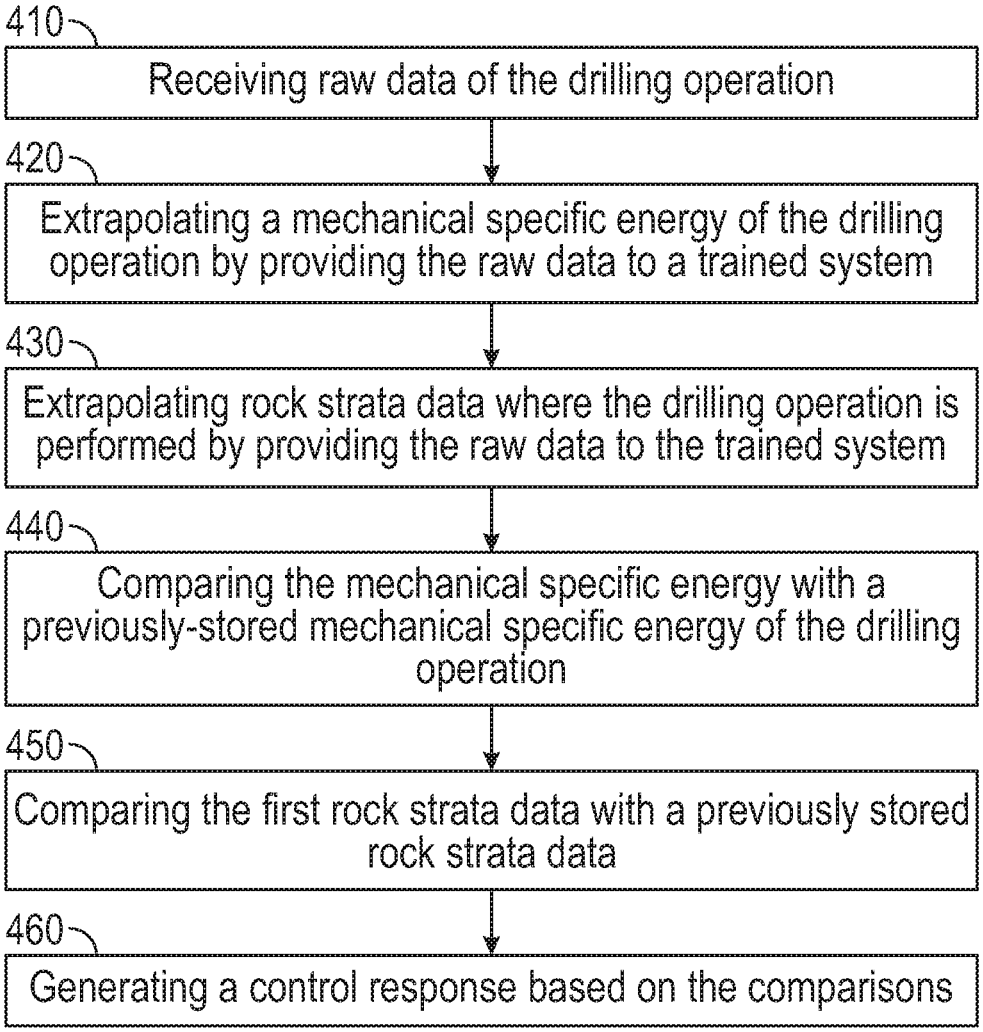
FIG. 4 depicts an illustrative method performed by the drilling rig control center, in accordance with various examples.

Referring now to FIG. 4, an example scenario that may be encountered by the drilling rig control center 105 will now be described. After receiving raw data (step 410) from the downhole sensors 145 present at the drilling operation, the processor 205 first filters them and then, using the trained system, the processor 205 infers that the mechanical specific energy of the drilling system is at 65% (step 420). The processor 205 also extrapolates that the drilling bit 135 is experiencing excessive vibrations, signifying that a vibrational-dysfunction exists (may be extrapolated in step 420). The processor 205, using the trained system, further infers the rock strata data. For example, the processor 205 may infer that there is a 90% probability that the drilling bit 135 is drilling through sandstone (step 430). The data extrapolated in steps 420 are compared with mechanical specific energy information extrapolated using the raw data received in a previous instance (step 440). For example, based on the instantly received raw data, the mechanical specific energy may have increased from 20% to 65%. The raw data received in the previous instance may be stored in the memory of the processor 205.

Similar to the step 440, the data extrapolated in step 430 is compared with rock strata data extrapolated using the raw data received in a previous instance (step 450). For example, rock strata comparison may reveal that the drilling bit 135 is now drilling through a new formation, which may is limestone. Thus, based on the comparison, the processor 205 may generate a control response (step 460) that may be provided at the parameter control and uphole sensor unit 115, which can (automatically or semiautomatically) change certain parameters (e.g., WOB) of the drilling system to optimize the drilling process. Stated another way, if there is a change (increase or decrease) in mechanical specific energy (MSE) of the drilling system without any operational change (no change to WOB, RPM), then the change could be due to a damaged downhole tool (bit, motor, etc.) or due to other mechanical failures. However, in most cases such a substantial difference in MSE can be attributed to a change in lithology.

Figure 5:
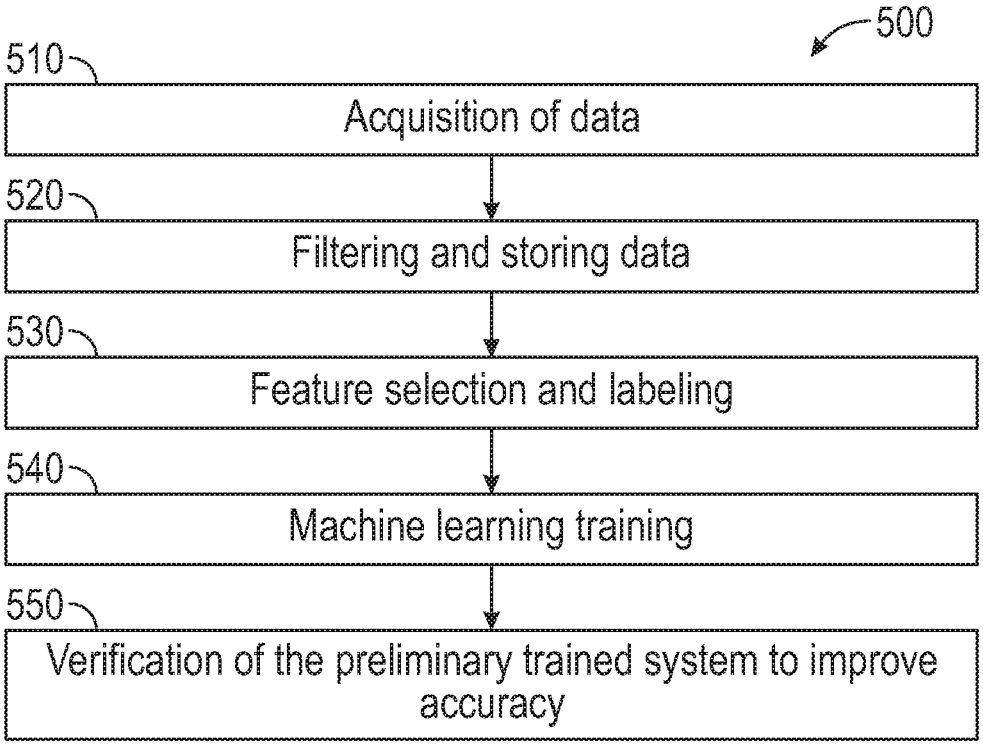
FIG. 5 depicts an illustrative method to train a trained system implemented by a processor unit, in accordance with various examples

Referring now to FIG. 5, an illustrative method 500 that may be used to train the trained system implemented by the processor unit 205. Method 500 describes one of the techniques that may be used to train a system; other methods/series of steps maybe utilized to form the trained system.

Method 500 begins with a step 510 that includes acquiring raw data related to a drilling operation. The raw data may be attained from multiple sources. In one example, a first raw data source is from laboratory or laboratory-like environments where a first set of raw data is acquired under controlled conditions. It is observed that the drilling outcome (e.g., displacement, dysfunctions) fluctuates while drilling through rock lithologies having varying properties (e.g., rock strength), when keeping the drilling parameters (e.g., such as WOB) constant. Therefore, the first set of raw data captures the predominant effects that different material types or attributes have on downhole sensor output values. For example, the first set of raw data captures the effect that changing lithologies have on downhole vibrations, mechanical specific energy, and rate of penetration (ROP). In addition, the data captures the effects of inefficient drilling or dysfunctions for a given rock type. For example, the tests may reveal that—for a particular set of parameters—while drilling from a carbonate sample to a shale sample, the MSE of the drilling operation increases, and other parameters, such as vibrations and torque oscillations, may indicate that a stick-slip dysfunction is occurring downhole. As is known in the art, stick-slip is a dysfunction characterized by asymmetric torsional oscillation that can reduce the MSE and damage the drilling equipment.

In the same example, a second raw data source may be held by a drilling company or may be attained by other sources, such as third party vendors who own the drilling equipment. The second raw data source provides a second set of raw data that include downhole and uphole sensor data of previously built wells. For example, the second set of raw data may include information describing general information about a well type, location, field, operator, equipment, drilling plan, instrumentation, and bottom hole assembly configuration. The second set of raw data may also include information related to the equipment used during drilling. The second set of raw data may also include historical data pertaining to the drilling operation, such as rotation per minute, weight on bit, mud flow rate, torque on bit, downhole accelerations, uphole and downhole temperatures, pumps pressures, annular pressures, and all this information may be timestamped. The aforementioned second set of raw data when combined with other metadata including contextual characteristics, such as, the equipment used, wellbore construction details, and geologic interpretation results, provides a different viewpoint and assists in understanding the historical data.

Method 500 proceeds to a step 520 that includes filtering and storing the filtered data. Before filtering the raw data may be preprocessed to remove electronic noise and other perturbations. In some examples, the raw data may also be down sampled. In some examples, the preprocessed data and down sampled data is first filtered using a fifth order median filter and then is again filtered using a third order Butterworth low-pass digital filter. In other examples, different combination of filters may be used. The filtration cutoff frequency may be selected based on frequencies, such as, dysfunction frequencies, relevant to the drilling operation. These filtered measurements are used to derive other measurements of the drilling operation. The other derived measurements may include downhole RPM, downhole torque, downhole vibrations; uphole WOB, uphole RPM, MSE, ROP, or torsional severity estimate (TSE), tri axial accelerations, depth of cut per revolution.

Following step 520, the method 500 moves to step 530 that includes feature selection and labelling. Feature selection, by definition, is the selection of relevant data. The trained system seeks to extract patterns and relationships between inputs and outputs in a dataset, and the system captures the relationship between inputs and outputs. Thus it is important to identify and select key indicators/features. After performing some tests, some parameters that can identify lithology type based on subtle differences in their drilling data were selected. These parameters include measurements such as WOB, RPM, ROP, top drive torque, surface accelerations, tri axial downhole accelerations, and tri axial downhole gyroscopic measurements. In some examples, the features may also include derived measurements such as depth of cut per cutter per revolution, MSE, tri axial downhole acceleration and its standard deviation, dominant acceleration frequencies, acceleration root mean square values. After selecting the key features, a set of reference lithologies or responses are manually labeled and added to a data set by correlating the lithologies to their physical depth. In other examples, labeling could be automated.

Following step 530, method 500 moves to step 540 that includes machine learning algorithm selection and training. Selecting one or more machine learning models is an iterative process and may require someone skilled in the art to evaluate the type, quality, quantity, and nature of the inputs and outputs. In some examples, the availability of processing power at the drilling site may also be a factor that dictates the selection of the most appropriate algorithm. In general, the objective is to develop means to predict future responses states based on past predictors and evaluating the general performance of a model for future data. Once a set of machine learning algorithms is selected, they are trained using the output of the step 530. In one example, supervised and unsupervised machine learning algorithms may be analyzed, trained, and verified to determine formation changes, vibration inefficiencies, and hidden relationships between the inputs and outputs. In addition, several methodologies to verify the biases, capture the most important predictors of a given set, normalize, and de-correlate predictors as well as other sampling techniques to diminish overfitting the models may be used.

Following step 540, the method 500 proceeds to step 550 that includes verification of the preliminary trained system to improve accuracy. The trained system may be verified by providing a test data set that improves the accuracy of the preliminary trained system (e.g., by iteratively performing step 540 using the test data set to re-train the preliminary trained system). In one example, running the preliminary trained system on a test dataset having different parameter settings (e.g., again performing step 540 using the test data set) will result in improving the accuracy of the system.

After performing the method 500, the trained system is ready to be employed in the drilling site 100 (FIG. 1). As noted above, the rate of penetration, weight on bit, torsional forces related data is received and/or derived from the downhole/uphole sensors. For linear trends, as an example, a moving average window is used to determine a predictive interval based on the standard deviation of previously acquired data for that interval. The trained system is configured to receive real-time sensor data; process the received data; and output a state prediction.

In one example, the term drilling operation can be defined as wellbore drilling, such as is used for petroleum exploration and production, and may include rotating a drill bit while applying axial force to the drill bit. The rotation and axial force is provided by relevant machines present on-site of the drilling operation.

In the foregoing discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect connection via other devices and connections. Similarly, a device that is coupled between a first component or location and a second component or location may be through a direct connection or through an indirect connection via other devices and connections. An element or feature that is "configured to" perform a task or function may be configured (e.g., programmed or structurally designed) at a time of manufacturing by a manufacturer to perform the function and/or may be configurable (or re-configurable) by a user after manufacturing to perform the function and/or other additional or alternative functions. The configuring may be through firmware and/or software programming of the device, through a construction and/or layout of hardware components and interconnections of the device, or a combination thereof. Additionally, uses of the phrases "ground" or similar in the foregoing discussion are intended to include a chassis ground, an Earth ground, a floating ground, a virtual ground, a digital ground, a common ground, and/or any other form of ground connection applicable to, or suitable for, the teachings of the present disclosure. Unless otherwise stated, "about," "approximately," or "substantially" preceding a value means +/−10 percent of the stated value.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

The above discussion is meant to be illustrative of the principles and various embodiments of the present disclosure. Numerous variations and modifications will become apparent to those skilled in the art once the above disclosure is fully appreciated. It is intended that the following claims be interpreted to embrace all such variations and modifications.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A method performed by a drilling rig control center, comprising:

receiving raw data for a first time segment, wherein the raw data comprises data related to a drill string or a drill bit;

deriving first drilling state data, including a first mechanical specific energy value, based on the raw data of the first time segment;

deriving first formation state data based on the raw data of the first time segment, wherein the formation state data comprises information pertaining to the formation;

correlating the first derived drilling state data and the first derived formation state data of the first time segment with second derived drilling state data and second derived formation state data of a second time segment, wherein the second derived drilling state data includes a second mechanical specific energy value derived from raw data of the drilling operation of the second time segment;

and implementing a control response based on the correlation, wherein the control response automatically changes a direction of drilling of a well.

2. The method of claim 1, wherein the raw data comprises real-time sensor data related to the drilling operation.

3. The method of claim 1, further comprising deriving the first drilling state data and the first formation state data using a trained system.

4. The method of claim 3, further comprising classifying, using the trained system, the first drilling state data and the first formation state data.

5. The method of claim 1, further comprising filtering the raw data before deriving the first drilling state data and the first formation state data.

6. The method of claim 1, wherein the control response provides an indication to improve drilling parameters of the drilling operation.

7. The method of claim 1, wherein the control response provides an indication to change a drilling direction of a well.

8. A method for real-time improvement of a drilling operation, comprising:

receiving raw data of the drilling operation, wherein the raw data comprises data related to a drill string or a drill bit;

extrapolating rock strata data for a location of the drilling operation by providing the raw data to the trained system;

comparing the extrapolated mechanical specific energy data with previously-stored mechanical specific energy data extrapolated from previous raw data of the drilling operation;

comparing the extrapolated first rock strata data with previously stored rock strata data extrapolated from previous raw data of the drilling operation;

and implementing a control response based on the comparisons, wherein the control response automatically changes a direction of drilling of a well.

9. The method of claim 8, wherein the control response provides an indication to change drilling parameters of the drilling operation.

10. The method of claim 9, further comprising providing the indication to change drilling parameters of the drilling operation via a display unit.

11. The method of claim 8, further comprising classifying, by the trained system, the mechanical specific energy data and the rock strata data.

12. The method of claim 8, further comprising periodically re-training the trained system using the raw data.

13. The method of claim 8, further comprising receiving the raw from a measurement-while-drilling sensor or a logging-while-drilling sensor.

14. A system, comprising:

a sensor data receiver unit configured to receive raw data for a first time segment, wherein the raw data comprises data related to a drill string or a drill bit;

a memory configured to store instructions to implement a trained system;

and a processor coupled to the memory and to the sensor data receive unit, wherein the instructions, when executed by the processor, cause the processor to be configured to:

derive first drilling state data, including a first mechanical specific energy value, based on the raw data of the first time segment;

derive first formation state data based on the raw data of the first time segment;

correlate the first derived drilling state data and the first derived formation state data of the first time segment with second derived drilling state data and second derived formation state data of a second time segment, wherein the second derived drilling state data includes a second mechanical specific energy value derived from raw data of the drilling operation of the second time segment;

and implement a control response based on the correlation, wherein the control response automatically changes a direction of drilling of a well.

15. The method of claim 1, wherein the formation state data comprises one or more selected from the group consisting of: rock type, lithology, porosity, permeability, and temperature.

16. The method of claim 1, wherein the formation state data comprises an inference of rock strata and a probability of correctness of the inference.

17. The method of claim 1, wherein the raw data comprises a weight on the drill bit, a torque on the drill bit, a depth of the drill bit, data related to a bending movement of the drill bit, a number of rotations per minute (RPM), or combinations thereof.

18. The method of claim 8, wherein the raw data comprises a weight on the drill bit, a torque on the drill bit, a depth of the drill bit, data related to a bending movement of the drill bit, a number of rotations per minute (RPM), or combinations thereof.

19. The system of claim 14, wherein the raw data comprises a weight on the drill bit, a torque on the drill bit, a depth of the drill bit, data related to a bending movement of the drill bit, a number of rotations per minute (RPM), or combinations thereof.

* * * * *